United States Patent [19]

Lyons, Jr.

[11] Patent Number: 5,072,465

[45] Date of Patent: Dec. 17, 1991

[54] SUSPENDABLE SLEEPING BAG

[76] Inventor: William J. Lyons, Jr., P.O. Box 1223, Tulsa, Okla. 74101

[21] Appl. No.: 553,742

[22] Filed: Jul. 18, 1990

[51] Int. Cl.[5] ..... A47F 3/22; A47G 9/08

[52] U.S. Cl. ..... 5/121; 5/123; 5/413; 135/90

[58] Field of Search ..... 5/413, 121, 120, 122, 5/123, 414; 135/90

[56] References Cited

U.S. PATENT DOCUMENTS

| | | | |
|---|---|---|---|
| 329,763 | 11/1885 | Nelmes et al. | 5/121 |
| 348,685 | 9/1886 | Nelmes | 5/121 |
| 967,949 | 8/1910 | Meredith | 5/121 |
| 1,071,764 | 9/1913 | Lowrimore | 5/122 |
| 1,156,200 | 10/1915 | Ashworth et al. | 5/121 |
| 1,257,984 | 3/1918 | Drexler | 5/120 |
| 2,284,900 | 6/1942 | Henderson et al. | 5/122 |
| 3,675,256 | 7/1972 | Tallarico et al. | 5/120 |
| 3,964,113 | 6/1976 | Dean, II | 5/121 |
| 4,001,902 | 1/1977 | Hall et al. | 5/121 |
| 4,605,029 | 8/1986 | Russell | 5/413 |

FOREIGN PATENT DOCUMENTS

| | | | |
|---|---|---|---|
| 1156226 | 5/1958 | France | 5/120 |

*Primary Examiner*—Alexander Grosz

*Attorney, Agent, or Firm*—Richard C. Litman

[57] ABSTRACT

For cold weather camping a sleeping bag is integrated with a hammock. The bottom side of the hammock is insulated. Padding is placed between the hammock and the occupant of the bag. Waterproof and bug covers are supported on a line above the bag. Inflatable spreaders are used in the hammock. The bag can be supported by side spreader lines attached to posts or to a cot frame. Support lines can be tightened with a turnbuckle. Insulation in the bag and below the hammock can be inflatable tube seaparated by breathable insulation. Insulation is secured to the entire bottom surface of the hammock by adhesion. Gravity hung material of appropriate material can be used in place of traditional insulating material. Appropriate moisture blocks are utilized to prevent moisture from entering the sleeping bag by way of support or other lines. A complete envelopment of the hammock/sleeping bag combination is achieved by an overhead suspended, axially displaceable wrapper openable to provide further protection against moisture and/or insects.

9 Claims, 5 Drawing Sheets

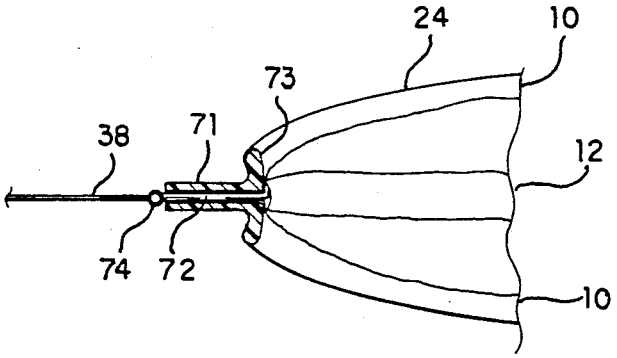
FIG. 11
FIG. 12a
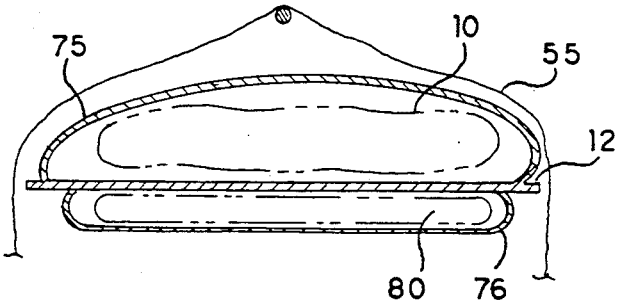
FIG. 12b
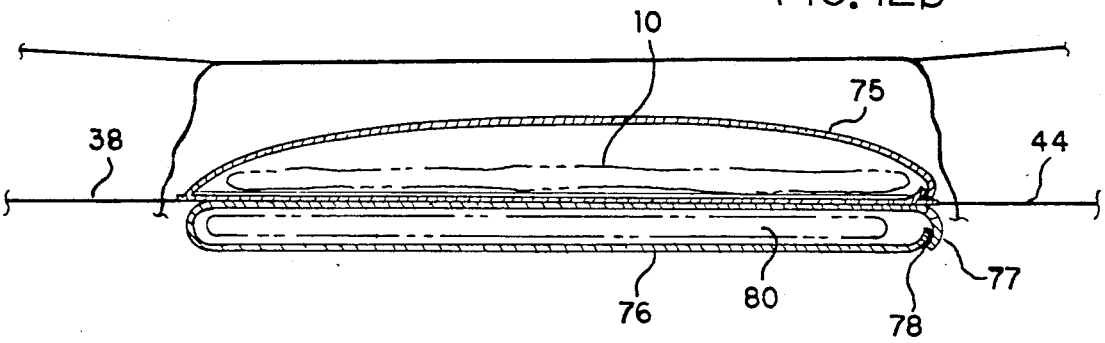

SUSPENDABLE SLEEPING BAG

BACKGROUND OF THE INVENTION

It is known in the art to suspend a sleeping bag above the ground like a hammock. Such a bag is disclosed in U.S. Pat. No. 3,675,256. The patent discloses a hammock having the top part of the sleeping bag above it and the bottom part of the bag below it. U.S. Pat. No. 1,071,764 discloses a sleeping hammock having slats. U.S. Pat. No. 615,907 discloses a combined cot and hammock and U.S. Pat. No. 1,204,416 discloses a baby hammock to be suspended in the back seat of an automobile.

While each of the above patents teach answers to problems in a particular art, many problems in the suspendable sleeping bag art are left unanswered by the prior art. These problems involve the problems created by bugs, rain, comfort, cold, size, compactability, use of modern materials, use of better insulation techniques, sag in both lengthwise and width-wise directions and dew collecting on the upper surface of the bag, to mention just a few.

SUMMARY OF THE INVENTION

The present invention provides answers to the above-recited problems left unanswered by the prior art.

The suspendable sleeping bag of the present invention, like the prior art, has a hammock-like support in combination with a sleeping bag. It differs from the prior art in that it has a layer of insulation attached at all points to an area of the lower side of the support means corresponding to the area of the support means to be occupied by a user of the sleeping bag. The insulation can be attached by chemical adhesive means, thermal means such as heat-bonding, hot-melt adhesives or other means known in the art such as foaming an open-pore polyurethane foam in place on the lower side of the support. The prior art did not teach attaching insulation over a total area, which allows for sag in the areas not attached, thus decreasing the effect of the insulation. This deficiency is particularly pronounced when the insulation becomes damp or wet and collapses.

To provide comfort for the user of the bag a layer of padding is attached to an area of the upper side of the support corresponding to the area of the support to be occupied by a user of the sleeping bag. This also provides some insulation, but since it is matted down during use it is not as effective as the insulation under the support. The thickness of the padding is approximately one-half as thick as the thickness of the insulation, generally speaking, but the ratio can be varied depending upon climate. The alternative of using a standard inflating pad or mattress placed in a pocket beneath the hammock is also a considered option. This would provide shape, but not be compressed, losing insulation value.

To prevent the occupant of the suspendable sleeping bag from getting wet from rain or dew an integrated waterproof cover designed to be supported at various distances above the bag is provided. The cover is preferably supported by a line stretched above the sleeping bag. The upper two-thirds of the cover which is above the bag can be made of a waterproof, but breathable material (i.e. GORTEX) and the bottom one-third of the bag can be made of a highly breathable material which extends below the bag to form a wrapper for the bag. The cover may also be made completely of waterproof, breathable material (GORTEX) designed to be used as a tent to both cover the sleeping bag and any equipment placed underneath the tent. However, if airflow over the bag is allowed, a simple waterproof material may be acceptale. This waterproof cover may also be cross utilized as a poncho.

In like manner the suspendable sleeping bag can be provided with an integrated mosquito/bug wrapper designed to be supported by the same line as the waterproof wrapper or a separate line stretched above the sleeping bag. This mosquito/bug wrapper may also be cross utilized as a wearable bug barrier.

A turnbuckle, a ratchet strap or other tensioning device known in the art can be employed to increase the tension on the support lines to reduce the amount of sag in the hammock. This is unique to this art.

In order to reduce weight and improve comfort an inflatable spreader can be located at a section of the hammock where a user's head would rest. Both width-wise and lengthwise inflatable spreaders can be attached to the support means, and except for the headrest, preferably on the lower side of the hammock and the top part of the sleeping bag where they provide insulation when in use without becoming compressed, thus losing insulation value. The spreaders are preferably long, inflatable tubes and preferably are separated by air-pervious insulation or air-pervious webs joining the tubes together.

The hammock portion of the suspendable sleeping bag can also have spreader lines running from the sides of the hammock to maintain the hammock level and to reduce bow or sag in the support means. The leveling effect of side support is unique to this art. The spreader lines can be attached to a cot frame.

BRIEF DESCRIPTION OF THE DRAWINGS

FIG. 11 is a top view in cross-section showing the moisture block; and

FIG. 12*a* is a cross-sectional view of an alternate embodiment.

FIG. 12*b* is a cross-sectional side view of the embodiment of FIG. 12*a*.

DETAILED DESCRIPTION OF THE INVENTION

Figure 6:
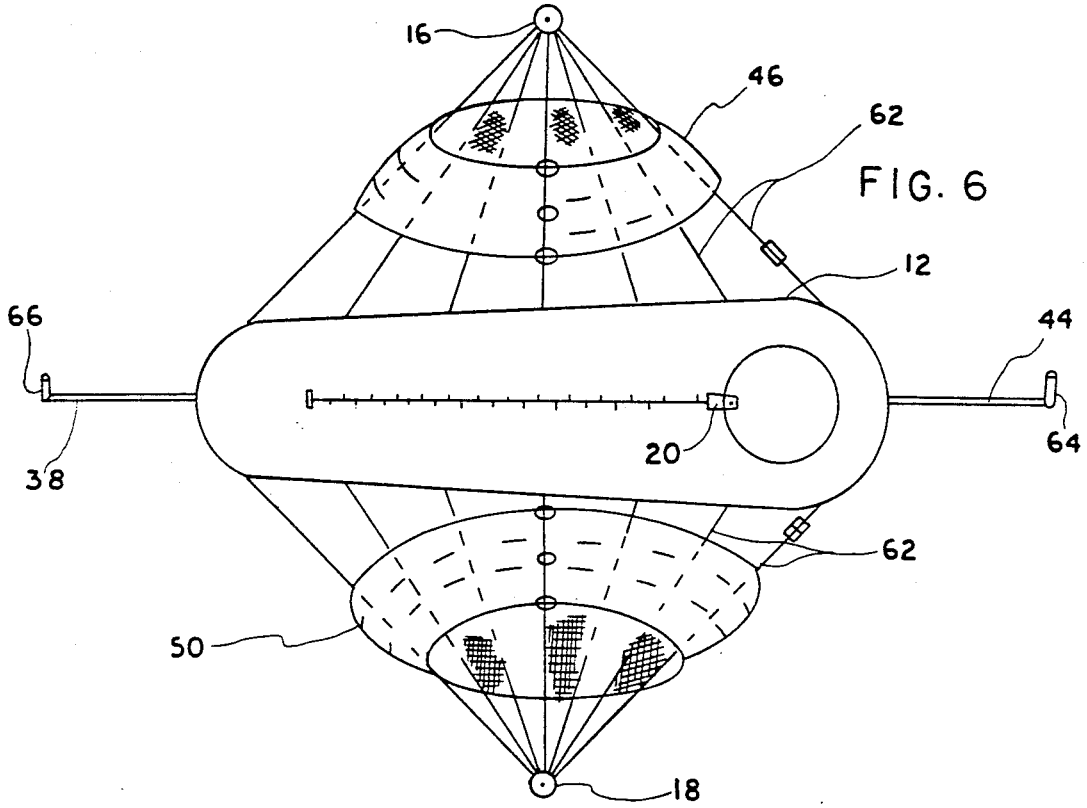
FIG. 6 is a top view of the bag of the present invention supported by side spreader lines.

Referring now to the drawings, FIGS. 1–10 broadly stated show a padded sleeping bag 10 integrally combined with an insulated hammock 12. The combination will be referred to herein as banana bag 14. Banana bag 14 in its usual application is suspended from spaced upright supports 16 and 18. In actual use these supports are generally trees. The banana bag 14 has a zipper 20 at the top or side for entry. A top view of banana bag 14 is shown in FIG. 6. In the present specification and claims "top" means the highest, "bottom" the lowest, "head" the part where the head goes and "foot" the part where the feet go.

The top 22 of sleeping bag 10 is composed of spaced inner and outer layers 24 and 26 of a fabric material such as nylon or Dacron filled with an insulating material 28 such as polyester or any other insulating material known in the sleeping bag art, including the synthetic hollow fibers and new self generating (hot/cold) fabrics similar to those recently developed. Insulation material may also consist of gravity hung material which may consist of any insulating material including the self generating or regulating materials recently available. Also the possibility of paper and plastic or other disposable material may be used especially if metalized. This would be especially practical for low volume and weight models used for aircraft and survival packaging.

The bottom 30 of sleeping bag 10 is composed of spaced inner and outer layers 32 and 34 filled with an insulating material 35 such as polyester fibers or any other padding material known in the sleeping bag art. Inner layer 32 is a material such as nylon, Dacron, cotton, GORTEX, or other breathable material including paper.

Insulated hammock 12 comprises occupant-supporting fabric 134, which is preferably woven of a high-strength, high-bulk low-density yarns such as cotton, Dacron, rayon, polyester or any of the yarns which have the above-described properties. To the upper side of fabric 134 is attached padding 36. The thickness of insulation 35 is preferably no less than twice as thick as the thickness of padding 36. The bottom layer of insulated hammock 12 is of a fabric 39 such as Gortex, Dacron or nylon, again a breathable material. Fabric 39 is attached to upper layer 32 by adhesive 37. A foot suspension line 38 is attached at the foot end of fabric 134 to suspend the foot end of banana bag 14 from support 16. A tensioner 40 such as a turnbuckle is used to tighten line 38 when banana bag 14 is suspended to level occupant-supporting fabric 134. An optional inflatable spreader 42 in the form of a plastic or other material tube may be disposed across and preferably attached into the head end of occupant-supporting fabric 134 to maintain this end in a generally flat condition during suspension and also may function as a pillow for the occupant. A head suspension line 44 is attached to the head end of occupant-supporting fabric 134 for the purpose of supporting banana bag 14 from support 18.

At the end of each suspension line 38, 44 is a moisture block 71, illustrated in FIG. 11. This moisture block 71 is constructed of NYLON or a similar plastic non-permeable material. At the center of the moisture block 71 is a metal or other strong core 72 that serves to strengthen the moisture block 71 so that it can withstand the tension stress of supporting weight on the hammock 12. The moisture block 71 is attached to the end of the hammock 12 by means of fitting the core 72 to the hammock 12 by any secure means including, but not limited to, hooks, clevis, rings, or other support attachments. The bags outer cover will then fit around portion 73 to form a moisture barrier. Economy models may use simple rubber washers around the suspension lines 38, 44. This fit may be elastic, spring, draw cord or other known means. Support lines 38, 44 are attached to rings 74.

The padded sleeping bag 10 may be removably attached by means such as a zipper, buttons, straps, snaps or enveloped in an outer pocket. In a further embodiment, depicted in FIG. 12, the sleeping bag 10 can be a conventional sleeping bag merely laid on top of insulated hammock 12 or enveloped in an outer pocket 75, with access by zipper or other means, designed to hold a conventional bag. In this embodiment there is a hollow envelope 76, or straps, disposed beneath the hammock 12. This envelope 76, or straps, is for holding an air mattress, inflating pad 80 or the like. This allows the user to utilize his own air mattress or pad as an insulator. By having the mattress 80 beneath the hammock 12 there is no weight on the mattress 80 that would compress it. The envelope 76 has a slit opening 77 that has a hook and loop type fastener zipper or other form of seal 78 that is easily opened, tightened or sealed closed to place in or remove the air mattress 80.

Figure 1:
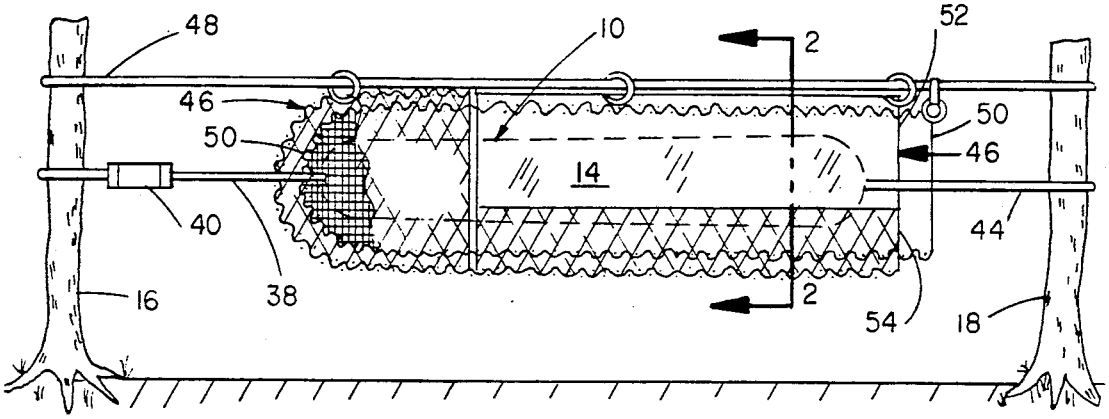
FIG. 1 is a side view of the sleeping bag of the present invention, partially in section, supported from spaced supports.
Figure 2:
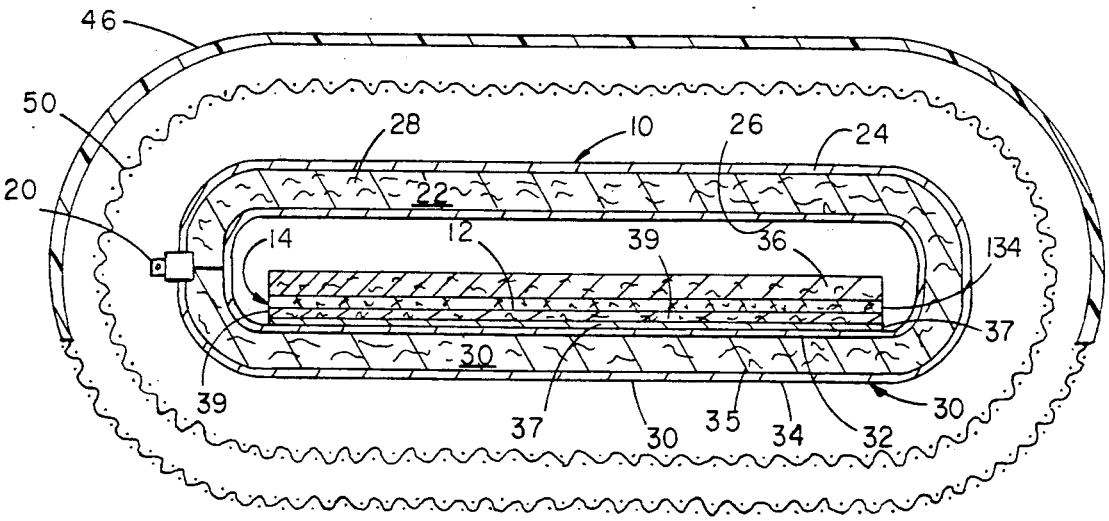
FIG. 2 is a cross-sectional view of the sleeping bag of FIG. 1.
Figure 3:
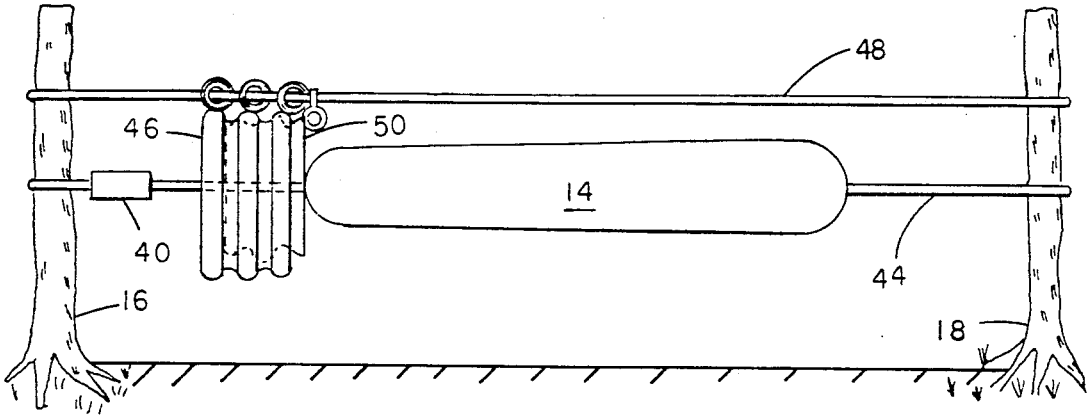
FIG. 3 corresponds to FIG. 1 with the waterproof wrapper and the mosquito/bug wrapper pushed back.
Figure 10:
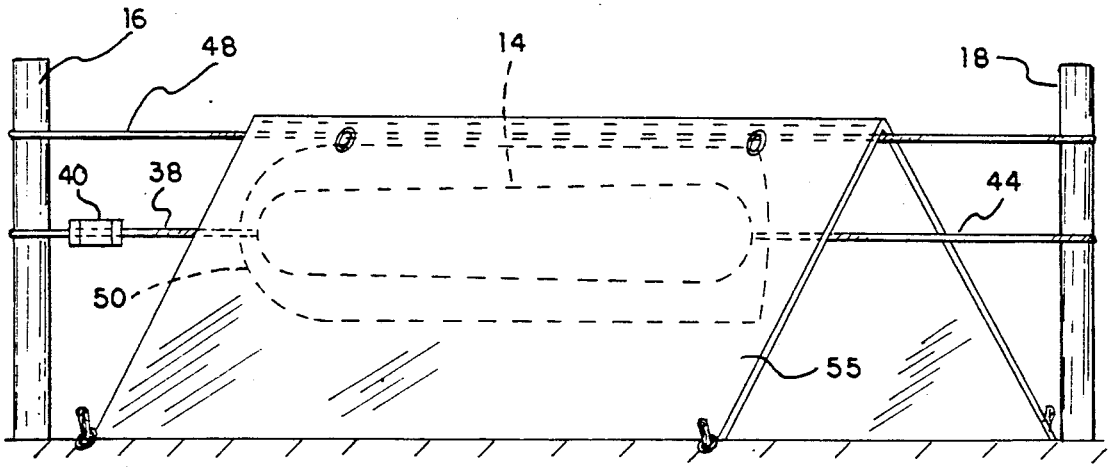
FIG. 10 is a view showing the waterproof wrapper used as a tent.

In order to protect the occupant of banana bag 14 from rain, dew and other precipitation, waterproof cover or wrapper 46 having a generally closed end and a generally open end is movably suspended on line 48 above banana bag 14. Line 48 is also attached to supports 16 and 18. Mosquito/bug wrapper 50 having a generally closed end and a generally open end is another optional wrapper and is movably supported in the same manner as optional waterproof cover 46. The upper two-thirds of cover 46 may be totally waterproofed with Gortex, or is made of coated nylon, plastic or other waterproof, preferably breathable material. The bottom one-third of cover 46 and other key ventilation areas may be of a breathable material to help pass moisture given off by the occupant. When waterproof cover 46 is used in the form of a tent as shown in FIG. 10, all of the cover 55 may be made of a waterproof material, such as that used in lightweight tents. As best seen in FIGS. 1-3, mosquito/bug wrapper 50 generally surrounds the sleeping bag, and cover 46 generally surrounds wrapper 50, with wrapping 50 and cover 46 adapted to slide on stretched line 48 to cover or uncover the sleeping bag.

Figure 4:
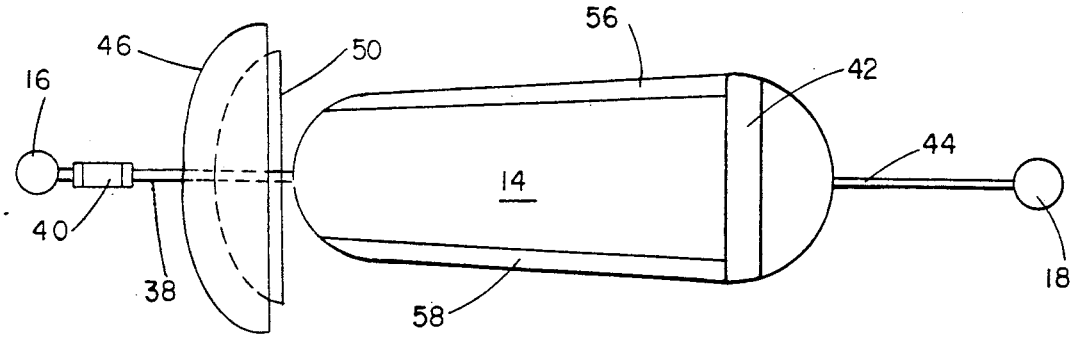
FIG. 4 is a top view, partially in section, showing inflatable spreaders in place.
Figure 5:
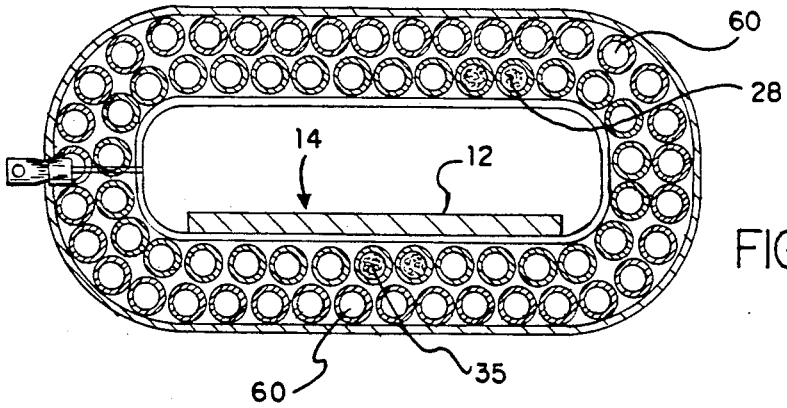
FIG. 5 is a cross-sectional view of the bag of the present invention containing inflatable tubes alternating with breathable material.

As is shown in FIG. 4, air-filled plastic or other appropriate material tubes 56 and 58 can also be employed as lengthwise inflatable spreaders attached to the top or bottom side of insulated hammock 12. In another embodiment shown in FIG. 5, insulating material 28 is used in the top side of sleeping bag 10, and insulation 35 of insulated hammock 12 is made from long inflatable tubes 60 separated by the before-described insulating breathable materials 28 and 35 respectively.

Figure 7:
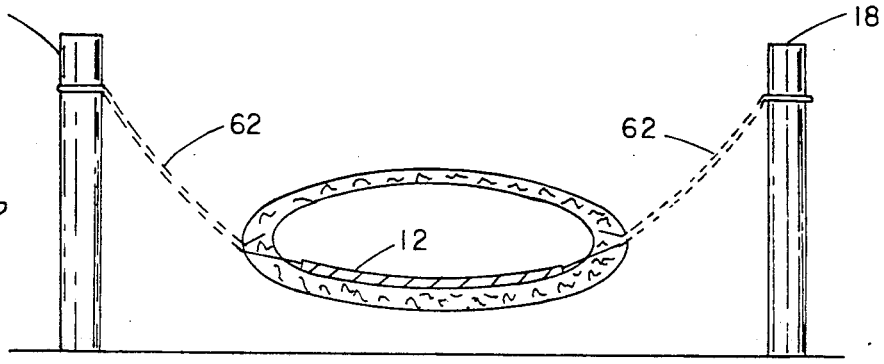
FIG. 7 is a width-wise cross-sectional view of the bag of FIG. 6.
Figure 8:
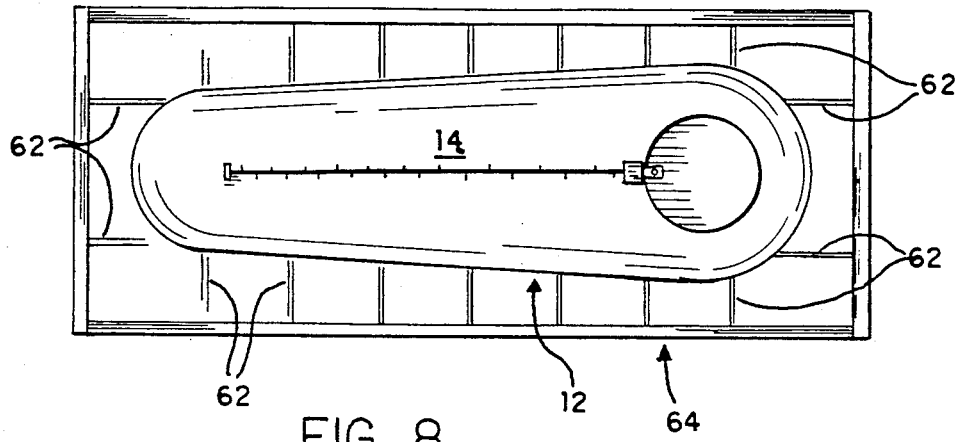
FIG. 8 is a top view of the bag of the present invention supported in a cot frame.
Figure 9:
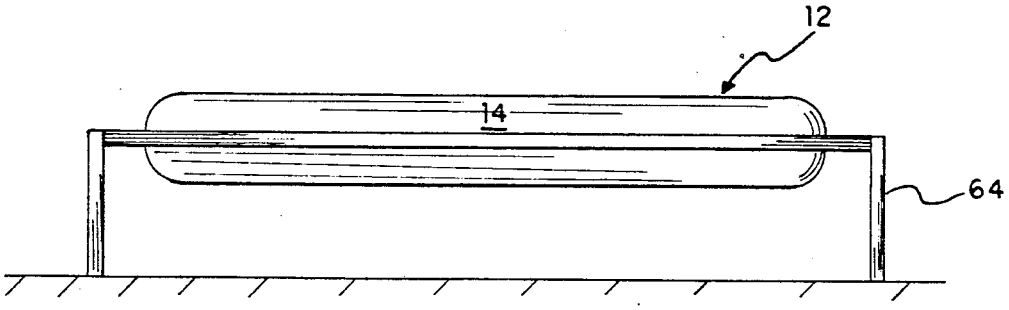
FIG. 9 is a side view of the bag of FIG. 8.

As is shown in FIGS. 6 and 7, spreader lines 62 can be run to supports 16 and 18 from the sides of insulated hammock 12. In this embodiment, head and foot suspension lines 44 and 38 become head and foot spreader lines 44 and 38 attached to the ground by stakes 64 and 66. Included with this embodiment are extra line tensioners. These can be adjusted to raise or lower the head as desired. As is shown in FIGS. 8 and 9, a banana bag 14 having side spreader lines can be attached to a cot frame 64.

I claim:

1. In a suspendable hammock-sleeping bag combination in which a bottom portion of an insulated sleeping bag is attached to a bottom portion of a hammock comprising suspending means, and a top portion of the insulated sleeping bag is adapted to cover a user resting on the top of the hammock, the improvement comprising:

an air permeable mosquito/bug wrapper adapted to be slidably supported on a line stretched above the suspended hammock-sleeping bag combination, and a waterproof cover adapted to be slidably supported on the same stretched line on which the wrapper is supported, the wrapper and the cover each having a generally closed end and a generally open end, the wrapper adapted to be spaced around and generally surround the hammock-sleeping bag combination, and the cover adapted to be spaced around and generally surround the wrapper, whereby the wrapper and the cover are adapted to be slid on the stretched line from a first position in which they are laterally spaced from the hammock-sleeping bag combination, to a second position in which they are in a surrounding and covering relationship to the hammock-sleeping bag combination.

2. The combination of claim 1, further comprising a padding attached to the top of the hammock.

3. The combination of claim 1, further comprising means to increase the tension on the hammock suspending means.

4. The combination of claim 1, further comprising an inflatable spreader disposed near a head section of the hammock.

5. The combination of claim 1, further comprising lengthwise inflatable spreaders attached to the hammock.

6. The combination of claim 1, wherein the insulated sleeping bag includes insulation comprising elongated, inflatable tubes filled with insulating breathable material.

7. The combination of claim 1, wherein both the mosquito/bug wrapper and cover may be utilized as a poncho when removed from the stretched line.

8. The combination of claim 1, further comprising spreader lines extending from the sides of the hammock.

9. The combination of claim 1, further comprising a moisture block disposed at opposite ends of the hammock.

* * * * *